US005629730A

United States Patent [19]

Park

[11] Patent Number: 5,629,730

[45] Date of Patent: May 13, 1997

[54] THERMAL PRINTER AND PRINTING METHOD THEREOF

[75] Inventor: Sang-sin Park, Suwon, Rep. of Korea

[73] Assignee: Samsung Electronics Co., Ltd., Kyungki-Do, Rep. of Korea

[21] Appl. No.: 243,784

[22] Filed: May 17, 1994

[30] Foreign Application Priority Data

May 17, 1993 [KR] Rep. of Korea ..... 1993-8418

[51] Int. Cl.[6] ..... B41J 2/36; B41J 2/37; B41J 2/365

[52] U.S. Cl. ..... 347/188; 347/192

[58] Field of Search ..... 347/183, 188, 347/190, 194, 195, 211, 192

[56] References Cited

U.S. PATENT DOCUMENTS 5,087,923 2/1992 Bruch ..... 347/194

*Primary Examiner*—Benjamin R. Fuller

*Assistant Examiner*—L. Anderson

*Attorney, Agent, or Firm*—Sughrue, Mion, Zinn, Macpeak & Seas

[57] ABSTRACT

A thermal printer includes a dot number computing memory for detecting the number of dots which are simultaneously heated according to gradation by receiving image dam in line units, a dot number computing controller, a thermistor for detecting the temperature of a thermal print head (TPH), and a corrector for controlling the TPH to emit heat by gradation with a constant energy by varying the pulse width of a strobe signal depending on the detected number of simultaneous heated-by-gradation dots and temperature of the thermal print head, and the printing method thereof.

20 Claims, 6 Drawing Sheets

40
T P H
DATA
STROBE
TPH VOLTAGE
TPH TEMPERATURE
60
50
30
34
COMPARATOR
33
GRADATION COUNTER
CLOCK GENERATOR
31
STROBE SIGNAL GENERATOR
55
COMMON DROP CORRECTING ROM
54
53
DOT NUMBER COMPUTING CONTROLLER
DOT NUMBER COMPUTING MEMORY
ADDR
DATA
WE
52
63
POWER SOURCE
62
TEMPERATURE CORRECTING ROM
61
A/D CONVERTOR
20
LINE MEMORY
ADDR
32
ADDRESS COUNTER
51
a
b
10
FRAME MEMORY

THERMAL PRINTER AND PRINTING METHOD THEREOF

BACKGROUND OF THE INVENTION

The present invention relates to a thermal printer and printing method thereof, and more particularly, to a thermal printer and printing method for compensating for picture quality deterioration due to a common drop and a temperature characteristic of a thermal print head.

In general, examples of an apparatus for printing using a thermal print head (TPH) include a thermal printer, a color copier, a facsimile machine, etc. Among these, a sublimation-type thermal printer prints a desired image or picture according to the amount of dye transferred to a sheet of recording paper, by applying energy to the TPH and sublimating the dye contained on a dye-deposited film by the energy emitted from the TPH.

A conventional thermal printer, as shown in FIG. 1, stores one frame of image data to be printed in its frame memory 10. When printing starts, the frame memory 10 transfers one line of the image data to be printed to a line memory 20 and to a first selection contact point a0 of a controlling switch 51.

The one line of image data to be printed is synchronized with the clock generated in a clock generator 31 and stored in the line memory 20 according to the address generated in an address counter 32. Gradation counter 33 generates gradation data having a value from 0–255, given that the image data is expressed in eight-bit form, and outputs the gradation data as an input signal to a comparator 34.

When data is read from line memory 20 and actually printed by the TPH 40, the data is printed according to its value and the gradation level. For example, if image data consists of eight bits, gradations of the printing of a single pixel can vary in value 0 to 255, and the TPH 40 can be made to print up to 255 times with respect to each pixel.

The gradation counter 33 increments in value from 1 to 255. Then, the output of gradation counter 33 and the eight bit image data of line memory 20 are compared in the comparator 34. As the result thereof, the output of comparator 34 becomes "high" or "low," thereby determining whether the dots of TPH 40 are to emit heat or not. Thus the gradation of the printed pixel will correspond to the value of the eight bit image data on a scale set by the gradation counter.

Controlling switch 51, dot number computing memory 52, dot number computing controller 53, common drop correcting ROM 54, and strobe signal generator 55 constitute a common drop correcting unit 50 for compensating picture quality deterioration due to a common drop of TPH 40. Analog-to-digital converter 61, temperature correcting ROM 62, and power source 63 composed of a switching mode power supply (SMPS) and a detecting temperature thermistor (neither being shown in detail) attached to the back side of the heating element substrate (see FIG. 2) of TPH 40, constitute a temperature correcting unit 60 for compensating for picture quality deterioration due to TPH temperature change.

Common drop of a TPH is understood to mean the generation of a voltage drop due to the parasitic resistance components present within the TPH 40. If the energy applied to the dots of the TPH 40 is varied by the voltage drop, the picture quality will deteriorate.

In other words, assuming that reference letter V represents the voltage applied to the respective heating elements of the TPH, and reference letter T represents the time during which heat is applied, the applied energy E can be expressed by the following equation.

$$E = T\left(\frac{V^2}{R}\right)$$

The common drop phenomenon has a characteristic such that the value of the voltage drop is nearly proportional to the number of the simultaneously heated dots in one line of the TPH 40; that is, the greater the number of simultaneously heated dots in a line of the TPH, the greater the voltage drop within TPH 40. Accordingly, the energy applied to the dots of the TPH 40 becomes smaller in effect, and thereby the printing density is lowered, such that printing is dimmer than for the case where fewer dots are simultaneously heated. Common drop correcting unit 50 corrects picture quality deterioration caused by the problem of common drop, by adjusting the heating period of a strobe signal which is based on the above mentioned proportional relationship between the common drop and the number of the simultaneously heated dots.

The TPH 40 performs printing by converting electrical energy into thermal energy through a resistance. Even if the same amount of electrical energy is applied, since the heat actually generated in the respective dots of TPH 40 varies with ambient temperature fluctuations and with a heat accumulation phenomenon occurring in the thermal print head, the printing density is varied. To correct the picture quality deterioration due to temperature changes in the TPH, a thermistor is installed on the back side of the heat element substrate of TPH 40 to detect the temperature of TPH 40. The detected temperature therein is converted to digital temperature data in analog-to-digital converter 61. Compensation data for detected temperature values of TPH 40 are stored in the temperature correcting ROM 62. Thereafter, compensation data for the detected temperature is obtained from the temperature correcting ROM, and the SMPS of power source 63 changes the voltage applied to TPH 40 according to the stored temperature data and thereby changes the applied energy of TPH 40.

In other words, the SMPS changes the voltage applied to TPH 40 in accordance with the input temperature data. For example, picture quality deterioration due to a temperature change is prevented by lowering the voltage if the temperature is high, or increasing the voltage if the temperature is low.

However, the temperature correcting unit 60 for correcting the TPH temperature requires a controlling circuit which can change the voltage according to the temperature dam input to the SMPS of power source 63 and further requires a connector for transmitting the temperature dam.

SUMMARY OF THE INVENTION

To overcome the above-described problems, an object of the present invention is to provide a thermal printer and method which corrects the temperature of the thermal print head, not by varying the voltage of a switching mode power supply, but by adjusting the heating period of the thermal print head, as in common drop correction.

Another object of the present invention is to provide a thermal printer and method which corrects common drop and temperature by apportioning the heating period of the TPH to a common-drop-correction heating period and a temperature-correction heating period.

Still another object of the present invention is to provide a thermal printer and method which corrects common drop and temperature by adjusting the heating period using a single ROM for both common drop and temperature correction.

To accomplish the above objects, the thermal printer according to the present invention, wherein printing is performed by a thermal print head after an image data gradation value is compared with a preset gradation value in line units, the thermal printer comprises:

first detecting means for detecting the number of dots which are simultaneously heated according to gradation, by receiving the image data in line units;

second detecting means for detecting the temperature of the thermal print head; and correcting means for controlling the thermal print head to emit heat with a constant energy according to gradation, by varying a heating period according to the simultaneous-heated-by-gradation dot number detected from the first detecting means and the temperature of the thermal print head detected from the second detecting means.

Yet another object of the present invention is to provide a printing method suitable for use with the above thermal printer.

To accomplish this object of the present invention, there is provided a method for printing by a thermal print head, comprising the steps of:

firstly storing image data in screen units;

secondly storing data in line units by reading the data stored in the first storing step;

firstly detecting the number of dots which are simultaneously heated according to gradation, by receiving the data stored in the first storing step, in line units;

secondly detecting the temperature of the thermal print head; generating a strobe signal for controlling the thermal print head to emit heat with a constant energy according to gradation, by varying the pulse width of the strobe signal according to the simultaneous-heated-by-gradation dot number detected in the first detecting step and the thermal print head temperature detected in the second detecting step; and controlling the thermal print head to print for the period of the pulse width of the strobe signal generated in the strobe signal generating step after the gradation value of one line image data is compared with a preset gradation value, in line units.

BRIEF DESCRIPTION OF THE DRAWINGS

The above objects and other advantages of the present invention will become more apparent from the following description of a preferred embodiment thereof with reference to the attached drawings in which.

DETAILED DESCRIPTION OF THE INVENTION

Throughout the drawings the same elements are designated by the same numbers.

Figure 3:
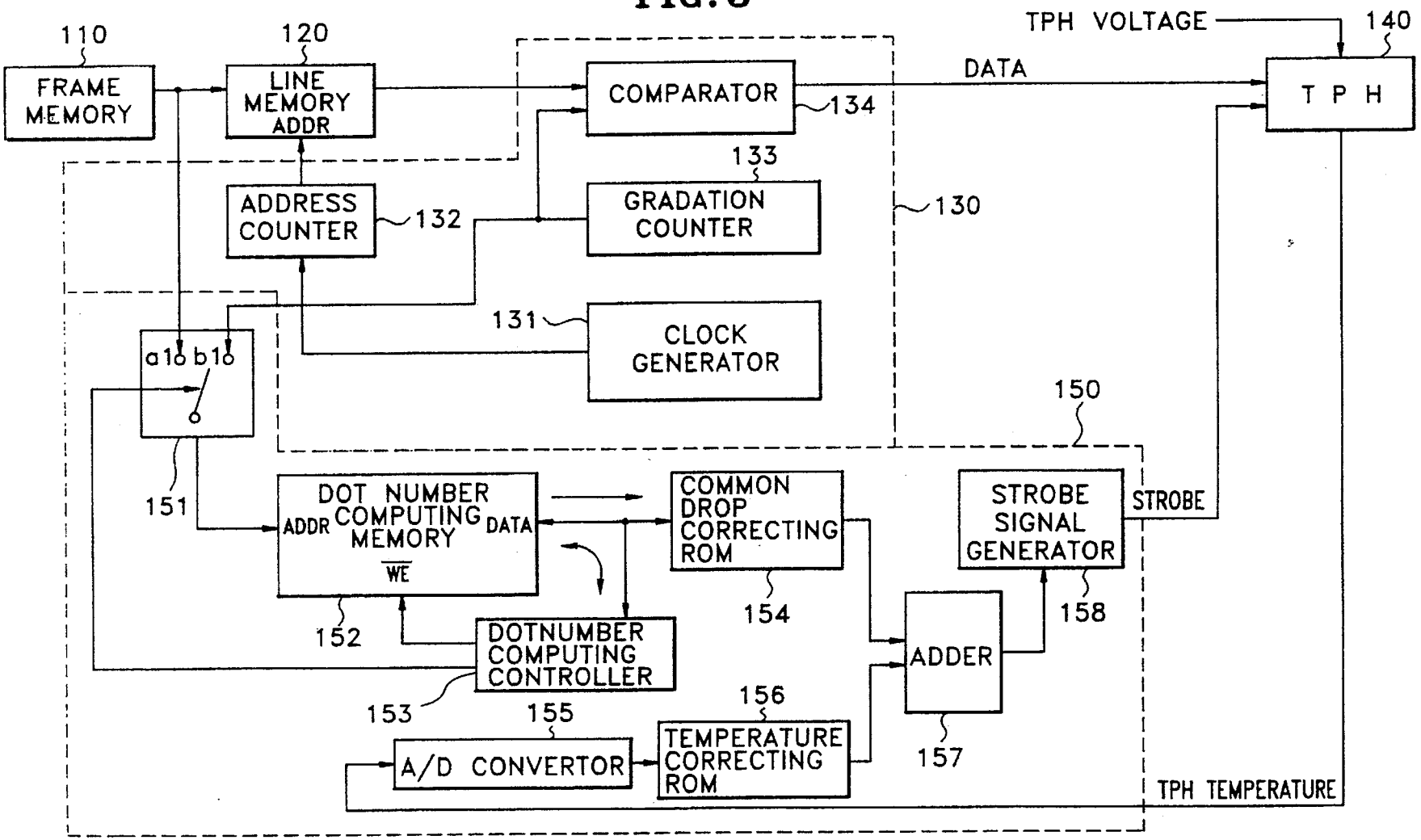
FIG. 3 is a block diagram of a thermal printer according to an embodiment of the present invention.
Figure 8:
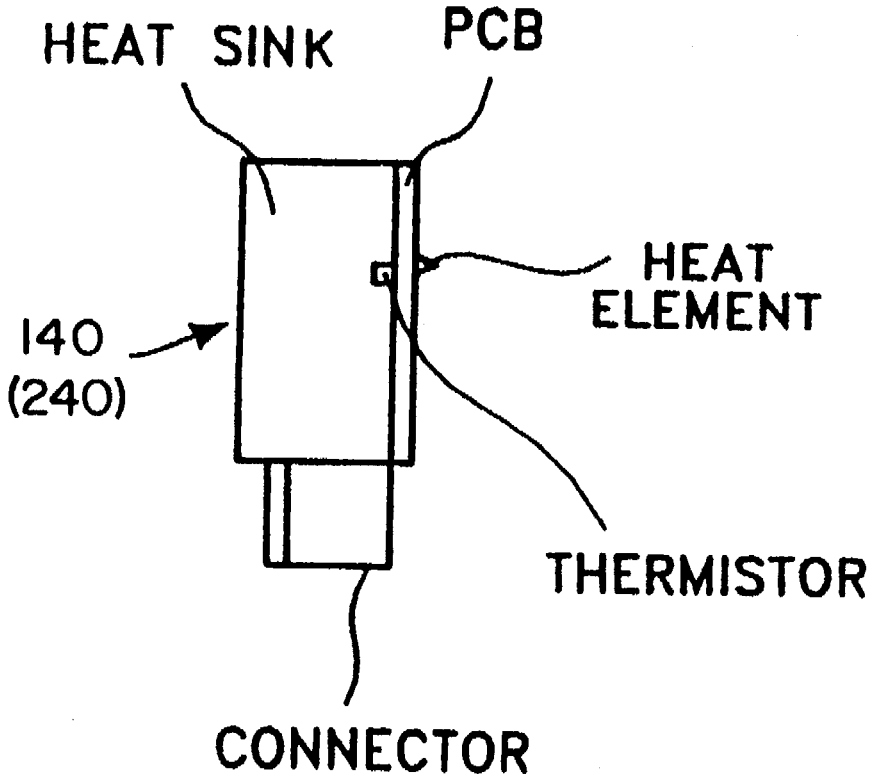
FIG. 8 is a schematic diagram showing a thermal print head (140; 240).

The thermal printer according to the present invention as shown in FIG. 3 is constituted by a frame memory 110 for storing the input image signal in frame units, a line memory 120 for storing the output from the frame memory 110 in line units, a TPH controlling unit 130 for gradation-comparing the image data from line memory 120 with a preset gradation value, a TPH 140 (see FIG. 8), and a correcting unit 150 for correcting common drop and temperature variations by apportioning a correction period for heating the TPH to a common-drop-correction heating period and a temperature-correction heating period in accordance with the ambient temperature and a heat accumulation phenomenon and in accordance with the number of dots which are simultaneously heated according to gradation.

Figure 5:
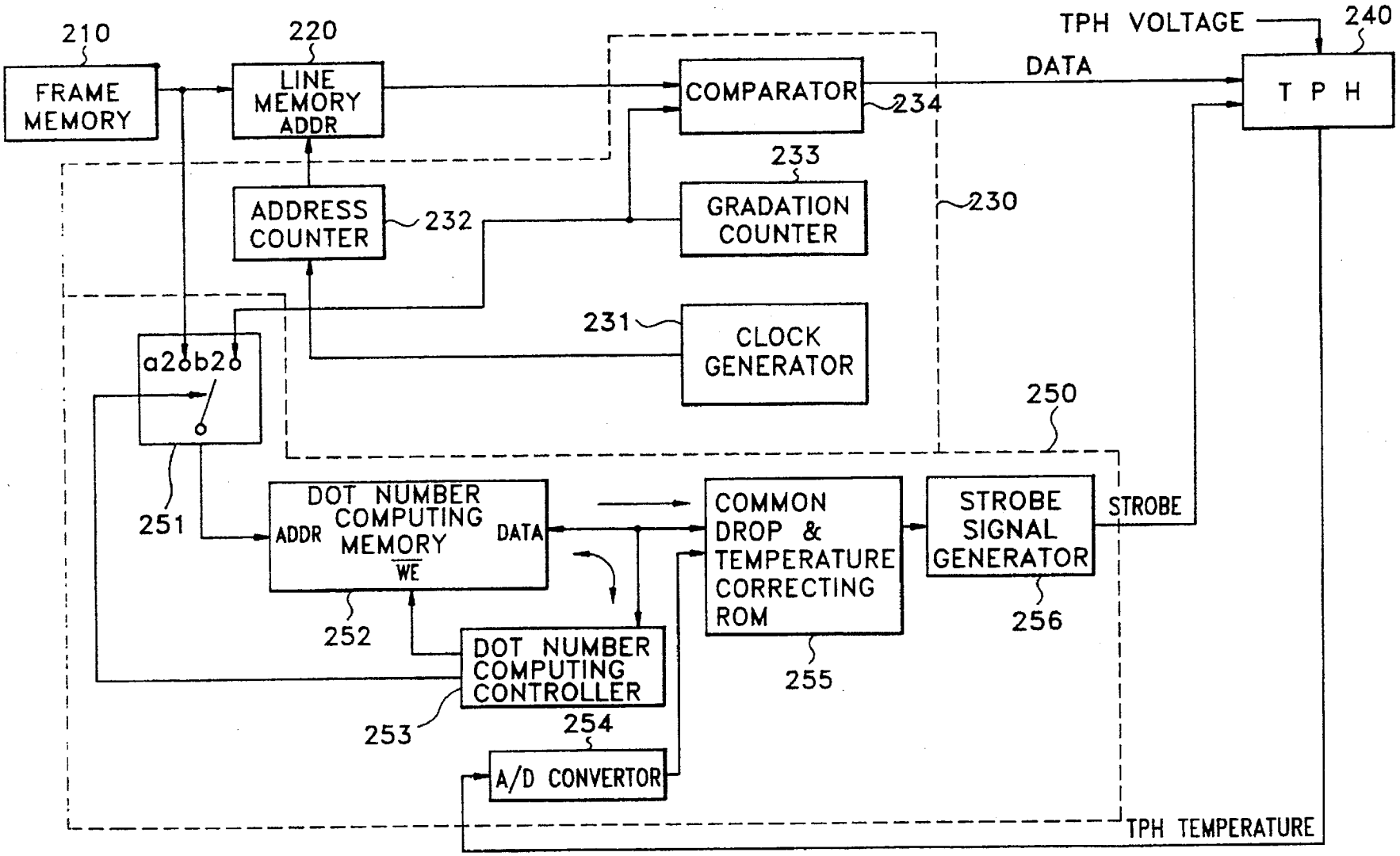
FIG. 5 is a block diagram of a thermal printer according to another embodiment of the present invention.

In another embodiment of the present invention, as shown in FIG. 5, the configuration of frame memory 210, line memory 220, TPH controlling unit 230 and TPH 240 are the same as those of the embodiment of FIG. 3. Here, however, the correcting unit 250 corrects common drop and temperature by varying the heating period using a single common drop and temperature correcting ROM.

The operation of each embodiment of the present invention will be described below.

Figure 1:
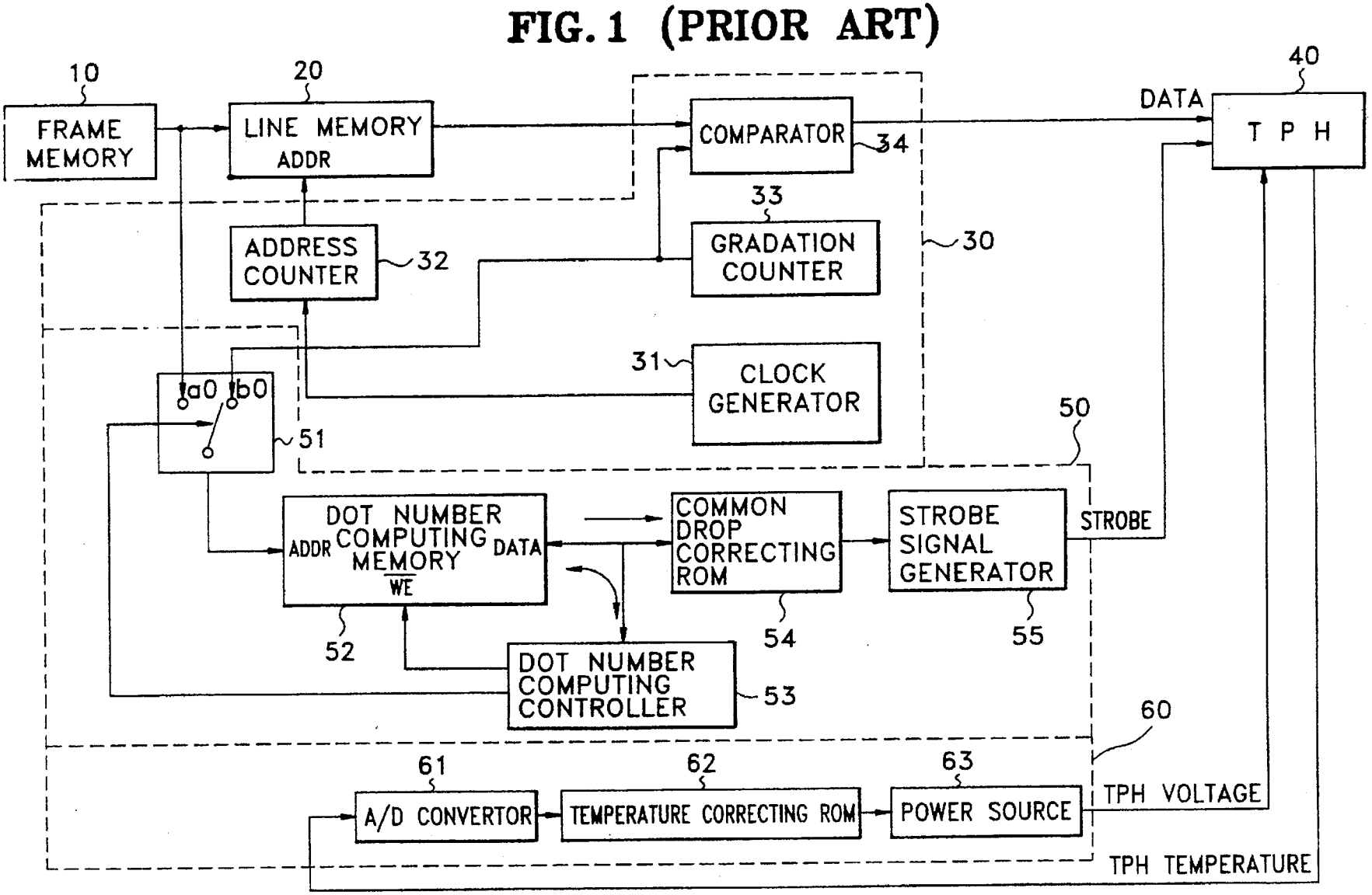
FIG. 1 (PRIOR ART)
FIG. 1 is a block diagram of a conventional thermal printer.

In FIG. 3, since the operations of frame memory 110, line memory 120, TPH controlling unit 130 and TPH 140 are the same as those of the corresponding elements shown in FIG. 1, the description thereof is omitted herein. The description of the operation of correcting unit 150 will be accomplished largely with reference to FIGS. 3 and 4.

Referring to FIG. 3, one line of data read from frame memory 110 is transmitted to line memory 120 and, at the same time, to the address terminal (ADDR) of a dot number computing memory 152 through a first selection contact point a1 of a controlling switch 151. Here, dot number computing memory 152 computes the number of dots simultaneously heated according to gradation.

The addresses corresponding to the gradation level (or number) are designated to dot number computing memory 152. Whenever the address is designated, the number in the designated address is incremented by a write enable signal output from a dot number computing controller 153. Here, dot number computing controller 153 is used to compute the number of dots simultaneously heated according to gradation; i.e., the number of dots in a line simultaneously heated for each level of gradation printing.

For example, in the case where eight bit data is used and the gradation levels are from 0 to 255, a single line of print can result in 255 consecutive printings of the line. Any data with gradation level 255 will print dots in the corresponding pixel each 255 times, whereas data with a gradation level of 1 will print only one time. The number of dots printed at any gradation level will depend upon the number of data samples per line and the gradation levels of the data in the single line.

For example, it will be assumed that the image data is composed of eight bits, and that a single line consists of 1,000 data samples. It is further assumed that one line of data samples consists of 100 samples having gradation level of "1" (i.e., the data value for 100 samples is "1"), 50 samples having a gradation level of "5", and 850 samples having a gradation level of "235". In the dot number computing memory 152 at addresses 1 through 255, there will be stored the number of data samples in the line having the gradation level corresponding to the address. That is, since 100 samples have a gradation level of "1", the number 100 is stored in address 1 of the computer 152. Likewise, the numbers 50 and 850 are stored in addresses 5 and 235, respectively, of dot number computing memory 152. The number 0 is stored in all the remaining addresses because there are no samples having the gradation levels corresponding to the remaining addresses.

The dot number computing controller 153 computes the number of dots simultaneously heated at each gradation level from the numbers stored in computer 152. As will be understood, at the gradation level 1 printing, each sample having a gradation level 1 or above will result in the printing of a dot. At gradation level 2 printing, each sample having a gradation level 2 or above will result in the printing of a dot, and so on, such that at gradation printing level 255, only those samples of gradation level 255 will result in printing a dot. These numbers are calculated by summing the numbers stored in the gradation level addresses of computer 152 as follows.

The numbers stored in the addresses 1 through 255 are summed and written in the address 1 of dot number computing memory 152. This information now constitutes the total number of dots to be printed simultaneously during the gradation level 1 printing of the line. The numbers stored in addresses 2 through 255 are summed and written in address 2, and likewise continuing throughout each address, with the last data value remaining in the address 255 without any summation operation occurring.

In the above-described manner, the number of dots simultaneously printed during each gradation level printing is computed. This is due to the printing being performed by gradations. When the gradation counter is "1", the gradation level "1" of the line of data is printed. In this case for every data sample having a gradation level of "1" or above there will be a dot printed. This is because the comparator will produce a "high" level output (signifying heat emission) for every data sample having a value equal or above the gradation level of gradation counter 133. When the counter 133 increments to gradation level "2", gradation level "2" is printed. That is, every data sample having a value equal to "2" or above will result in the output of comparator 134 being high and the printing of a dot. The counter increments up to 255, and for each value the TPH prints a line of dots, depending upon the samples having values equal to or exceeding the value provided by the gradation counter. After the data corresponding to gradation 255 is thermally printed the printing of one line of data is completed. The data in the computing memory 152 is read out under control of addressing data from the gradation counter 133. The data (numbers) from gradation counter 133 are applied to the address input of memory 152 via terminal b1 of switch 151. Each number causes readout of data from the corresponding address in the memory 152. Therefore, for example, the gradation level 125 from counter 133 causes read out of the information in address 125 of memory 152. This information (or number) represents the number of dots to be simultaneously printed during gradation level 125 printing. Thus, for each level output from gradation counter 133, memory 152 outputs a number corresponding to the number of simultaneously printed dots at the given gradation level.

The output from memory 152 selects from a common drop correcting ROM 154 data representing correction needed based on the number of simultaneously heated dots according to the above mentioned proportional relationship. This common drop compensating data is added to temperature compensation data from the temperature correcting ROM 156 in an adder 157, and the output of adder 157 is transmitted to a strobe signal generator 158.

Strobe signal generator 158 generates and varies the width of a strobe signal depending on the data output from common drop correcting ROM 154 and temperature correcting ROM 156 and controls the heating period of the TPH 140.

The applied energy to the TPH 140 varies depending on the pulse width of the strobe signal. For example, the longer the pulse width of the strobe signal, the more energy is applied. Accordingly, the greater the number of the simultaneously heated dots, the longer the pulse width of the strobe signal becomes, thereby correcting the decline in energy due to a common drop.

The temperature correction of the TPH 140 is performed as follows. The present temperature is detected from the thermistor (not shown) installed on the back side of the heating element substrate of TPH 140 and is converted into digital data in an analog-to-digital converter 155. The digital output from converter 155 is applied to the temperature correcting ROM 156. A temperature correcting ROM 156 stores temperature compensating data for various temperatures and effectively converts the input digital temperature data into output compensating data for compensating for the detected temperature.

The adder 157 transmits the result of adding the compensating data for common drop obtained from correcting ROM 154 and the temperature compensating data from the temperature correcting ROM 156 to a strobe signal generator 158. The strobe signal generator produces an output strobe pulse which varies in width in dependence upon the input thereto. The strobe signal is applied to the TPH 140 and simultaneously compensates for common drop and temperature correction in accordance with the pulse width of the strobe signal.

The pulse width of the strobe signal is in proportion to the data value input to strobe signal generator 158. In other words, the greater the dam value becomes, the longer the pulse width of the strobe signal becomes. Also, the applied energy to the TPH 140 increases in proportion to the pulse width of the strobe signal.

Figure 4:
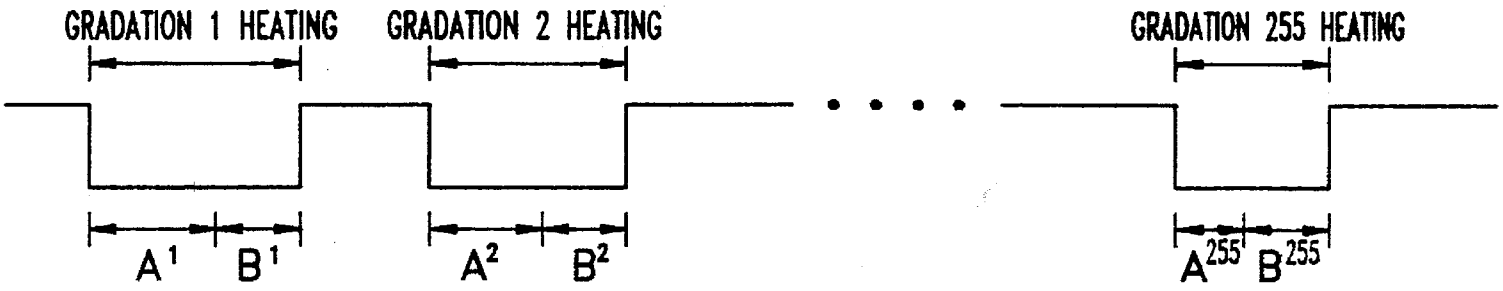
FIG. 4 is a view of a strobe signal generated in the strobe signal generator shown in FIG. 3.

FIG. 4 shows examples of strobe pulses provided during the printing of the gradation levels for the example set forth above. Each strobe pulse has a part that is due to the common drop compensating data from ROM 154 and a part due to the temperature compensating data from ROM 156. In the first strobe pulse, which is for gradation 1 level heating, the portion $A^1$ represents the portion of the strobe pulse width for the common drop correction. The portion $A^2$ represents the portion of the strobe pulse width for the common drop correction when gradation 2 is printed, and $A^{255}$ represents the portion of the strobe pulse width for the common drop correction when gradation 255 is printed. Since the number of simultaneously printed dots will differ at each printing level, the portion of the width of the strobe pulse due to common drop compensation will differ for each printing level. The portion $B^1$ of the strobe pulse width represents the temperature correction when gradation 1 is printed, $B^2$ represents the portion of the strobe pulse width for the temperature correction when gradation 2 is printed, and $B^{255}$ represents the portion of the strobe pulse width for the temperature correction when gradation 255 is printed.

The pulse width portions $B^1$ through $B^{255}$, for the temperature correction, may have the same width during the printing of the gradation levels of the same line.

The maximum and minimum values of the pulse width of the strobe signal are determined according to the system characteristics of the thermal printer. It is extremely important to set the dam value input to the strobe signal generator 158 so as not to deviate from the maximum and minimum values of the pulse width of the strobe signal in any sublimation-type thermal printer, because the pulse width of the strobe signal is a factor of the applied energy to TPH 140 (see above equation). With respect to the TPH applied energy specifications established so as to obtain a system's optimal picture quality, if these specifications are exceeded or not yet reached, the optimal picture quality may not be obtained and the TPH itself may also be damaged.

In consideration of the maximum and minimum values of the pulse width of the strobe signal, the data value input to strobe signal generator 158 should be set within a predetermined range that does not deviate from the maximum and minimum values so as to perform an optimal common drop and temperature correction.

That is, the value of the temperature correcting data from ROM 156 is set to cause an output having the maximum value when the TPH temperature detected is the lower limit value set by the system. The higher the temperature becomes, the higher the printing density becomes. Accordingly, in order to compensate for this phenomenon, the higher the TPH temperature becomes, the lower the amount of energy that should be applied to the TPH. Then, the greater the number of simultaneously heated dots, the lower the voltage applied to TPH 140 via common drop correcting ROM 154, adder 157 and strobe signal generator 158. Accordingly, the printing density is reduced.

The data value regarding the temperature correction and the data value regarding the common drop correction, set as described above, should be set so that the added value of the respective maximum values thereof is at most the maximum value of the pulse width of the strobe signal set by the system. Conversely, the added value of the respective minimum values thereof is at least the minimum value of the pulse width of the strobe signal set by the system.

FIG. 5 is a block diagram of the thermal printer according to another embodiment of the present invention. The description will be made mainly regarding a correcting unit 250, which is different from the corresponding portion of FIG. 3.

Contrary to the system of FIG. 3, the system of FIG. 5 does not have separate ROMS for common drop correction and temperature correction and does not have an adder for adding the data output from those ROMs. However, in order to obtain the same result as that of FIG. 3, a single common drop and temperature correcting ROM is used. The single ROM is programmed so that the respective common drop data and temperature correction data are added within the ROM itself.

Figure 6:
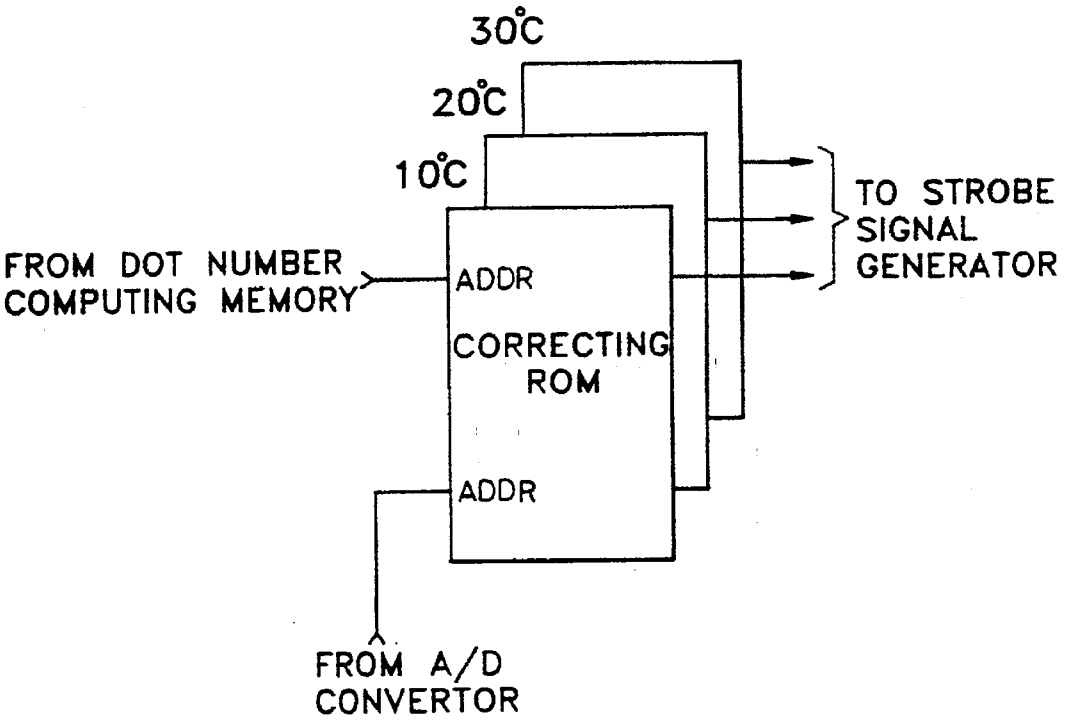
FIG. 6 shows the common drop and temperature correcting ROM shown in FIG. 5.
Figure 2:
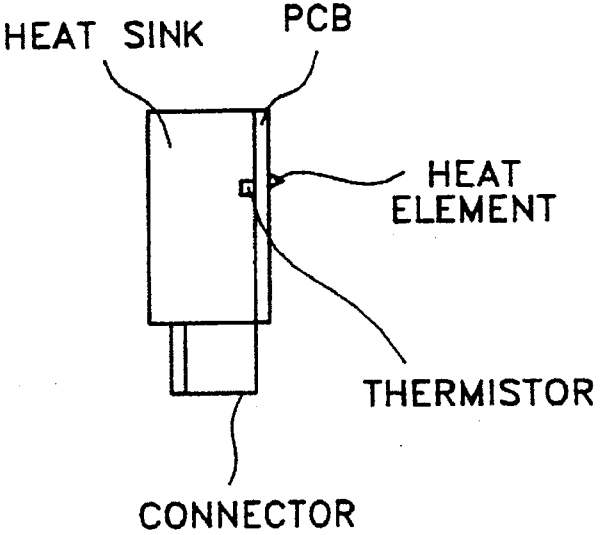
FIG. 2 (PRIOR ART)
FIG. 2 is a schematic diagram showing a thermistor attached to the thermal print head shown in FIG. 1.

In the ROM 255 there are stored data corresponding to the correction amount for various temperatures input from the analog to digital convertor 254 and for the number of simultaneously heated dots input from the dot number computing memory 252. As shown in FIG. 6, the ROM may be organized so that the temperature data from converter 254 addresses a section of the ROM corresponding to the temperature, and the dot number data from the computing memory 252 addresses a location within the addressed section to output compensation data unique to the temperature and the dot number information. A strobe signal generator 256 generates a strobe signal having the corresponding pulse width according to the correction data output from common drop and temperature correcting ROM 255.

Figure 7:
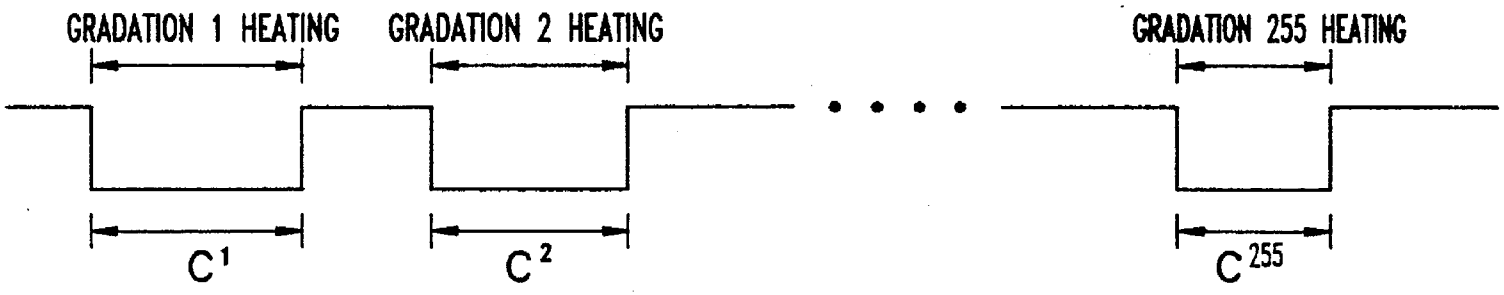
FIG. 7 is a view of a strobe signal generated in the strobe signal generator shown in FIG. 5.

The pulse width of the strobe signal is shown in FIG. 7. Here, $C^1$ represents the pulse width of the correction data output from common drop and temperature correcting ROM 255 when gradation 1 is printed, $C^2$ represents the pulse width of the correction data output from the common drop and temperature correcting ROM 255 when gradation 2 is printed, and $C^{255}$ represents the pulse width of the correction data output from common drop and temperature correcting ROM 255 when gradation 255 is printed.

As described above, the thermal printer and method using the same according to the present invention improves picture quality by compensating the picture quality deterioration due to the common drop and temperature characteristics of a TPH, by using varied heating periods of the TPH.

Also, the thermal printer and method using the same according to the present invention can reduce the volume of hardware, by correcting TPH temperature by adjusting the heating period of a thermal print head as in common drop correction, without using the SMPS voltage variation, because neither a control circuit for varying voltage depending on the temperature data input to the internal SMPS of a power source unit nor a connector for transmitting temperature data are required.

What is claimed is:

1. A system for compensating for common drop and thermal print head (TPH) temperature in a thermal printer of the type having, said thermal print head (TPH), which receives a strobe signal and printing data, including heating elements which produce dots on a printing medium when said heating elements are heated during a heating period, gradation controlled printing means, which outputs the printing data to said TPH, for printing a line of input data according to a gradation scale corresponding to a predetermined number of gradation levels by causing said TPH to print a number of successive dots for a given pixel, the number of dots printed depending upon the gradation scale and said value of the input data for the given pixel, a system for compensating for common drop and TPH temperature comprising:

first detecting means, which receives the line of input data and an addressing data output from said gradation controlled printing means, for developing data representing a number of dots simultaneously printed by said TPH in a given gradation level of printing;

second detecting means for developing data representing the temperature of said TPH;

correcting means which outputs the strobe signal to said TPH responsive to said data from said first and second detecting means for controlling the heating period of said TPH during printing of each gradation level to compensate for the temperature of said TPH and the common drop during each gradation level of printing.

2. The thermal printer of claim 1, wherein said correcting means comprises:

means responsive to said first detecting means for providing common drop compensation data representing a heating duration for said TPH, said heating duration having a proportional relationship to said number of dots simultaneously printed;

means responsive to said second detecting means for providing temperature compensating data representing a heating duration for said TPH, said heating duration being an amount needed to compensate for said data representing said temperature of said TPH;

an adder for combining said common drop compensating data and said temperature compensating data to obtain a sum;

a strobe pulse generator responsive to the sum obtained from said adder for generating a strobe pulse having a duration dependent upon said sum from said adder; and means in said TPH responsive to said strobe pulse for heating said TPH a duration corresponding to the duration of said strobe pulse during the printing of a given gradation printing of data.

3. The thermal printer of claim 2, wherein said means responsive to said first detecting means, comprises:

a common drop correcting ROM having data values representing heating duration values stored at locations defined by the number of dots printed per gradation level of printing, whereby said ROM responds to an input dam representing a given number of simultaneously printed dots by addressing a location defined by said input data and reading out the data representing a heating duration from said addressed location; the relation between said addressed location and the data in a location being a known proportional relationship between the number of dots printed simultaneously and the duration of heating needed to compensate for common drop caused by said number.

4. The thermal printer of claim 2, wherein said means responsive to said first detecting means, comprises:

a common drop correcting ROM responsive to said data representing a number of dots simultaneously printed for outputting data representing the duration of heating needed to compensate for common drop caused by the simultaneous printing of said number of dots.

5. The thermal printer of claim 4, wherein said means responsive to said second detecting means, comprises;

a temperature compensating ROM responsive to said data representing the temperature of said TPH for outputting data representing the duration of heating needed to compensate for the temperature of said TPH.

6. The thermal printer of claim 5, wherein said TPH defines preset characteristics and wherein said strobe pulse generator provides a pulse with a minimum and maximum duration preset according to the preset characteristics of said TPH.

7. The thermal printer of claim 6, wherein said first detecting means comprises:

a dot number computing memory responsive to a block of image data to be printed for computing and storing the number of dots to be simultaneously printed at each gradation level of printing for said block of data.

8. The thermal printer of claim 6, wherein said first detecting means comprises:

computing memory means responsive to a line of image data to be printed for storing at locations representing respective gradation levels of printing;

computing controller means, cooperating with said computing memory means and responsive to said last mentioned stored numbers for summing said numbers and storing in locations representing gradation levels the number of simultaneously printed dots at each said gradation level of printing; whereby the latter stored numbers are output at the corresponding gradation level of printing of said thermal printer.

9. A thermal printer as claimed in claim 8, wherein said second detecting means comprises:

a temperature sensor, for generating a temperature output, installed on a back side of a heat element substrate of said TPH;

an analog-to-digital converter for converting the temperature output from said temperature sensor into a digital signal; said digital signal constituting said data representing the temperature of said TPH.

10. The thermal printer as claimed in claim 9, wherein said means responsive to said second detecting means for providing temperature compensating data representing a heating duration for said TPH, comprises;

a temperature compensating ROM responsive to said digital signal input from said analog to digital converter for outputting data representing the duration of heating of said TPH necessary to compensate for the temperature of said TPH; said temperature compensating ROM storing duration values corresponding to temperature values at addresses corresponding to said temperature values.

11. A thermal printer as claimed in claim 2, wherein said second detecting means comprises:

a temperature sensor, for generating a temperature output, installed on a back side of a heat element substrate of said TPH;

an analog-to-digital converter for converting the temperature output from said temperature sensor into a digital signal; said digital signal constituting said data representing the temperature of said TPH.

12. The thermal printer as claimed in claim 11, wherein said means responsive to said second detecting means for providing temperature compensating data representing a heating duration for said TPH, comprises;

a temperature compensating ROM responsive to said digital signal input from said analog to digital converter for outputting dam representing the duration of heating of said TPH necessary to compensate for the temperature of said TPH; said temperature compensating ROM storing duration values corresponding to temperature values at addresses corresponding to said temperature values.

13. A thermal printer as claimed in claim 1, wherein said correcting means comprises:

a common drop and temperature correcting ROM responsive to said data from said first and second detecting means for outputting data representing the heating period of said TPH needed to compensate for the temperature of said TPH and the common drop of said TPH due to the number of dots simultaneously printed in a given gradation level of printing;

a strobe pulse generator responsive to said data output from said temperature correcting ROM for generating a strobe pulse having a duration dependent upon said data from said ROM; and means in said TPH responsive to said strobe pulse for heating said TPH a duration corresponding to the duration of said strobe pulse during the printing of a given gradation printing of data.

14. The thermal printer of claim 13, wherein said first detecting means comprises:

computing memory means responsive to a line of image data to be printed for storing at locations representing respective gradation levels of printing, the number of data samples in said line of image data having a data value corresponding to said respective gradation level;

computing controller means, controlling said computing memory means and responsive to said last mentioned stored numbers for summing said numbers and storing in locations representing gradation levels the number of simultaneously printed dots at each said gradation level of printing; whereby the latter stored numbers are output at the corresponding gradation level of printing of said thermal printer.

15. A thermal printer as claimed in claim 14, wherein said second detecting means comprises:

a temperature sensor, for generating a temperature output, installed on a back side of a heat element substrate of said TPH;

an analog-to-digital converter for converting the temperature output from said temperature sensor into a digital signal; said digital signal constituting said data representing the temperature of said TPH.

16. The thermal printer of claim 15, wherein said TPH defines preset characteristics and wherein said strobe pulse generator provides a pulse with a minimum and maximum duration preset according to the preset characteristics of said TPH.

17. A method for compensating for common drop and thermal print head (TPH) temperature in thermal printer of the type having, said thermal print head (TPH) including heating elements which produce dots on a printing medium when said heating elements are heated during a heating period, gradation controlled printing means for printing a line of input data according to a gradation scale corresponding to a predetermined number of gradation levels by causing said TPH to print a number of successive dots for a given pixel, the number of dots printed depending upon the gradation scale and a value of the input data for the given pixel, said method for compensating for common drop and TPH temperature comprising the steps of:

developing data representing a number of dots simultaneously printed by said TPH in a given gradation level of printing;

developing data representing the temperature of said TPH;

controlling, in response to said data representing the number of dots simultaneously printed and said data representing the temperature, the heating period of said TPH during printing of each gradation level to compensate for the temperature of said TPH and the common drop during each gradation level of printing.

18. The method of claim 17, wherein the step of controlling comprises:

providing, in response to said data representing the number of dots simultaneously printed, common drop compensation data representing a heating duration of said TPH, said heating duration having a proportional relationship to said number of dots simultaneously printed;

providing, in response to said data representing the temperature, temperature compensating data representing a heating duration for said TPH, said heating duration being an amount needed to compensate for said data representing said temperature of said TPH;

combining said common drop compensating data and said temperature compensating data;

generating, in response to the combined data from said step of combining said common drop compensating data and said temperature compensating data, a strobe pulse having a duration dependent upon said combined data; and heating said TPH a duration corresponding to the duration of said strobe pulse during the printing of a given gradation printing of data.

19. The method of claim 18, wherein the step of providing common drop compensation data comprises:

storing in a ROM data representing the duration of heating said TPH to compensate for common drop caused by various numbers of simultaneously printed dots; the said stored data being stored at locations corresponding to the number of simultaneously printed dots;

addressing said ROM with a number corresponding to the number of simultaneous dots to be printed and reading out therefrom the stored data which is stored in a location corresponding to said address.

20. The method of claim 19, wherein the step of providing temperature compensating data representing a heating duration for said TPH, comprises:

storing in a temperature compensating ROM data representing the duration of heating needed to compensate for the temperature of said TPH; said stored data being stored in locations of said ROM corresponding to the temperature of said TPH; and addressing said temperature compensating ROM with said data representing the temperature of said TPH for causing said ROM to output data from said addressed location.

* * * * *